US007833951B2

(12) United States Patent
Hayashi et al.

(10) Patent No.: US 7,833,951 B2
(45) Date of Patent: Nov. 16, 2010

(54) WATER-SOLUBLE METAL WORKING LUBRICANT

(75) Inventors: Noboru Hayashi, Saitama (JP); Katsuhiko Shiotsuki, Saitama (JP); Mitsuru Osawa, Saitama (JP); Masato Kaneko, Chiba (JP); Hideo Kanamori, Chiba (JP)

(73) Assignees: Honda Motor Co., Ltd., Tokyo (JP); Idemitsu Kosan Co., Ltd., Tokyo (JP)

( * ) Notice: Subject to any disclaimer, the term of this patent is extended or adjusted under 35 U.S.C. 154(b) by 694 days.

(21) Appl. No.: 10/544,345

(22) PCT Filed: Feb. 3, 2004

(86) PCT No.: PCT/JP2004/001062

§ 371 (c)(1),
(2), (4) Date: Dec. 7, 2005

(87) PCT Pub. No.: WO2004/069968

PCT Pub. Date: Aug. 19, 2004

(65) Prior Publication Data

US 2006/0240996 A1 Oct. 26, 2006

(30) Foreign Application Priority Data

Feb. 3, 2003 (JP) ..... 2003-025477

(51) Int. Cl.
*C10M 173/00* (2006.01)
*C10M 137/06* (2006.01)
*C10M 141/10* (2006.01)

(52) U.S. Cl. ..... 508/110; 508/433; 508/440; 508/441; 508/442; 508/539

(58) Field of Classification Search ..... 508/185, 508/186, 187, 198, 346, 349, 421, 460, 564, 508/156, 158
See application file for complete search history.

(56) References Cited

U.S. PATENT DOCUMENTS

| | | | | | |
|---|---|---|---|---|---|
| 4,450,087 | A | * | 5/1984 | Askew et al. | 252/73 |
| 5,368,758 | A | * | 11/1994 | Gapinski | 508/273 |
| 5,561,104 | A | * | 10/1996 | Miyagawa et al. | 508/421 |
| 6,103,673 | A | * | 8/2000 | Sumiejski et al. | 508/186 |
| 6,310,011 | B1 | * | 10/2001 | Karn et al. | 508/460 |
| 6,511,946 | B1 | | 1/2003 | Theis et al. | |

FOREIGN PATENT DOCUMENTS

| | | | |
|---|---|---|---|
| JP | 62-086096 | | 4/1987 |
| JP | 62-129388 | | 6/1987 |
| JP | 62-149795 | | 7/1987 |
| JP | 11-279581 | | 10/1999 |
| JP | 11279581 | A * | 10/1999 |
| JP | 2000-309793 | | 11/2000 |
| JP | 2002-226884 | | 8/2002 |
| JP | 2002-234112 | | 8/2002 |
| JP | 2002-309281 | | 10/2002 |

* cited by examiner

*Primary Examiner*—Glenn A Caldarola
*Assistant Examiner*—Taiwo Oladapo
(74) *Attorney, Agent, or Firm*—Oblon, Spivak, McClelland, Maier & Neustadt, L.L.P.

(57) ABSTRACT

The invention provides a water-soluble metal working lubricant which is suitably employed particularly in press-working of aluminum material and which is excellent in both working properties and degreasing properties.

The water-soluble metal working lubricant includes 85 mass % or less of water (A); 5 to 75 mass % of a metal salt of an organic carboxylic acid (B) wherein carboxylic acid residue has 8 or more carbon atoms in total and the acid/alkali ratio by mole is 1:0.5 to 1.1; 1 to 50 mass % of at least one metal salt (C) selected from among an organic phosphate ester metal salt, an organic phosphite ester metal salt, an organic phosphonate metal salt, and an organic borate ester metal salt, each having an alkyl group having 8 or more carbon atoms in total; and 10 to 80 mass % of a non-ionic surfactant (D).

12 Claims, No Drawings

WATER-SOLUBLE METAL WORKING LUBRICANT

RELATED APPLICATION

This application is a national stage entry of PCT/JP04/01062, filed Feb. 3, 2004 which is a continuation of Japanese Patent Application No. 2003-025477, filed Feb. 3, 2003, which is incorporated by reference in its entirety.

TECHNICAL FIELD

The present invention relates to a water-soluble metal working lubricant, and more particularly to a water-soluble metal working lubricant preferably employed in forging, press-working, drawing, ironing, bending, form rolling, or rolling of metallic materials (e.g., steel, stainless steel, aluminum alloy, and copper), inter alia, in press-working of aluminum material.

BACKGROUND ART

Conventionally, mineral-oil-based or wax-based working oil has been used in press-working of aluminum material. However, mineral-oil-based working oil exhibits poor working properties due to lack of ability to form satisfactory oil film, and wax-based working oil exhibits poor degreasing properties due to insolubility of wax in water. Thus, there has been keen demand for development of a metal working lubricant that is excellent in working properties and degreasing properties. Several types of water-soluble metal working lubricants have been disclosed in documents; e.g., a water-soluble metal working lubricant composed of polyoxyalkylene glycol and a dibasic carboxylic acid (Japanese Patent Publication (kokoku) No. 39-14568); a water-soluble metal working lubricant a polybasic carboxylic acid having 14 or more carbon atoms (Japanese Patent Application Laid-Open (kokai) No. 58-160396); a water-soluble metal working lubricant composed of a reaction product of a C12-C42 aliphatic dicarboxylic acid and an alkanolamine (Japanese Patent Application Laid-Open (kokai) No. 61-40400); and a specific phosphate ester (Japanese Patent Application Laid-Open (kokai) No. 2001-214183). However, these water-soluble metal working lubricants are unsatisfactory, and further improvement in properties thereof is demanded.

DISCLOSURE OF THE INVENTION

The present invention has been made under such circumstances, and an object of the invention is to provide a water-soluble metal working lubricant that is excellent in both working properties and degreasing properties.

The present inventors have carried out extensive studies in order to attain the object, and have found that the object can be attained by a water-soluble metal working lubricant containing water, a specific organic carboxylic acid metal salt, a specific organic phosphate ester metal salt or a similar compound, and a non-ionic surfactant, at predetermined proportions. The present invention has been accomplished on the basis of this finding.

Accordingly, the gist of the present invention is as follows.

1. A water-soluble metal working lubricant comprising 85 mass % or less of water (A); 5 to 75 mass % of a metal salt of an organic carboxylic acid (B) wherein carboxylic acid residue has 8 or more carbon atoms in total and the acid/alkali ratio by mole is 1:0.5 to 1.1; 1 to 50 mass % of at least one metal salt (C) selected from among an organic phosphate ester metal salt, an organic phosphite ester metal salt, an organic phosphonate metal salt, and an organic borate ester metal salt, each having an alkyl group having 8 or more carbon atoms in total; and 10 to 80 mass % of a non-ionic surfactant (D).

2. A water-soluble metal working lubricant as described in 1. above, which further comprises 0.01 to 10 mass % of a biodegradation inhibitor and/or a metal deactivator (E).

3. A water-soluble metal working lubricant as described in 1. above, wherein water serving as component (A) is contained in an amount of 75 mass % or less.

4. A water-soluble metal working lubricant as described in any of 1. to 3. above, wherein the metal salt serving as component (B) or (C) is an alkali metal, a divalent metal, or a trivalent metal-salt.

5. A water-soluble metal working lubricant as described in 1. above, which has a kinematic viscosity of 5 to 10,000 $mm^2/s$ at 40° C.

6. A water-soluble metal working lubricant as described in 1. above, wherein the metal subjected to working is aluminum.

BEST MODES FOR CARRYING OUT THE INVENTION

The water-soluble metal working lubricant of the present invention contains water, serving as component (A), in an amount of 85 mass % or less on the basis of the total amount of the lubricant. The water content is preferably 75 mass %, more preferably 50 mass % or less, particularly preferably 40 mass % or less. When the water content is in excess of 85 mass %, working properties decreases.

The organic carboxylic acid metal salt, serving as component (B) of the water-soluble metal working lubricant, has a carboxylate residue having 8 or more carbon atoms in total and has an acid/alkali ratio by mole of 1:0.5 to 1.1. When the carboxylate residue has 7 or less carbon atoms in total, working properties is poor. Thus, the carboxylate residue preferably has 12 or more carbon atoms, more preferably 12 to 40 carbon atoms. When the acid/alkali ratio by mole falls outside the range of 1:0.5 to 1.1, working properties is poor. Examples of the organic carboxylic acid includes the following.

(1) Linear saturated fatty acids: nonanic acid, lauric acid, palmitic acid, stearic acid, behenic acid, and montanic acid.

(2) Branched saturated fatty acids: 2-methyldecanoic acid, 6-propylnonanic acid, 4-methyldodecanoic acid, 12-methyltridecanoic acid, 4-methyltetradecanoic acid, 2-ethyltetradecanoic acid, 14-methylheptadecanoic acid, 16-methylheptadecanoic acid (isostearic acid), 5-methyloctadecanoic acid, and 2-butyloctadecanoic acid.

(3) Linear monoenic unsaturated fatty acids: cis-2-nonenoic acid, caproleic acid, 10-undecenoic acid, linderic acid, 2-tridecenoic acid, 5-tetradecenoic acid, myristoleic acid, cis-6-hexadecenoic acid, trans-9-octadecenoic acid, oleic acid, cis-9-eicosenoic acid, trans-13-docosenoic acid, and erucic acid.

(4) Branched monoenic unsaturated fatty acids: 3-methyl-2-nonenoic acid, 5-methyl-2-undecenoic acid, 5-methyl-2-tridecenoic acid, and 2-propyl-9-octadecenoic acid.

(5) Polyenic unsaturated fatty acids: hiragoic acid, linoleic acid, linolenic acid, arachidonic acid, clupanodonic acid, and nisinic acid.

(6) Acetylenic acids: tariric acid, stearolic acid, and ximenynic acid.

(7) Alicyclic fatty acids: malvalic acid, hydnocarpic acid, and gorlic acid.

(8) Oxygen-containing fatty acids: sabinic acid, jalpinolic acid, ricinoleic acid, and licanic acid.

(9) Dibasic acids: sebacic acid, dodecanedicarboxylic acid, tridecanedicarboxylic acid, ethylhexadecanedicarboxylic acid, 8,13-dimethyleicosanedioic acid (e.g., IPS-22, product of Okamura Oil Mill, Ltd.), 9,12-dimethyl-8,12-eicosadienedioic acid (e.g., IPU-22, product of Okamura Oil Mill, Ltd.), and 8,9-diphenylhexadecanedioic acid (ST-2P, product of Okamura Oil Mill, Ltd.).

Among these organic carboxylic acids, oleic acid, erucic acid, palmitic acid, ethylhexadecanedicarboxylic acid, 8,13-dimethyleicosanedioic acid, 9,12-dimethyl-8,12-eicosadienedioic acid, and 8,9-diphenylhexadecanedioic acid are preferred.

Examples of preferred metal elements forming the aforementioned organic carboxylic acid metal salts include alkali metals such as lithium, sodium, and potassium; and divalent or trivalent metal elements such as magnesium, calcium, zinc, and aluminum. These organic carboxylic acid metal salts may be used singly or in combination of two or more species.

The organic carboxylic acid metal salt is used in an amount of 5 to 75 mass % on the basis of the total amount of the lubricant, preferably 5 to 60 mass %, more preferably 10 to 40 mass %. When the metal salt content is less than 5 mass %, working properties is poor, whereas when the content is in excess of 75 mass %, the lubricant has excessively high viscosity, causing difficulty in handling such as coatability.

Component (C) of the water-soluble metal working lubricant of the present invention is at least one metal salt selected from among an organic phosphate ester metal salt, an organic phosphite ester metal salt, an organic phosphonate metal salt, and an organic borate ester metal salt, each having an alkyl group having 8 or more carbon atoms in total. When the number of total carbon atoms is 7 or less, working properties is poor. Thus, the number of total carbon atoms is preferably 12 or more, more preferably 12 to 40.

The aforementioned organic phosphate ester metal salt is represented by formula (1) or (2);

$$R^1O(R^2O)P(=O)OMe \quad (1)$$

$$R^3OP(=O)(OMe) \quad (2)$$

wherein each of $R^1$ and $R^2$ represents an alkyl group having 8 or more carbon atoms in total; $R^3$ represents an alkyl group having 8 or more carbon atoms; and Me represents a metal element.

Specific examples include octyl acid phosphate metal salts, indecyl acid phosphate metal salts, tridecyl acid phosphate metal salts, oleyl acid phosphate metal salts, and metal lauryl phosphate salts.

Alternatively, organic diphosphate esters; and organic polyphosphate esters such as pyrophosphates, triphosphates, trimetaphosphates, and tetrametaphosphates may also be employed.

The aforementioned organic phosphite ester metal salt is represented by formula (3) or (4):

$$R^1O(R^2O)POMe \quad (3)$$

$$R^3OP(OMe)_2 \quad (4)$$

wherein $R^1$, $R^2$, $R^3$ and Me have the same meanings as defined above.

Specific examples include dioleyl phosphite ester metal salts, and nonylphenyl phosphite metal ester salts.

The aforementioned organic phosphonate metal salt is represented by formula (5) or (6):

$$R^1(R^2O)P(=O)OMe \quad (5)$$

$$R^3P(=O)(OMe)_2 \quad (6)$$

wherein $R^1$, $R^2$, $R^3$ and Me have the same meanings as defined above.

Specific examples include monolauryl phosphonate metal salts, and mono-2-ethylhexyl 2-ethylhexyl phosphonate metal salts.

The aforementioned organic borate ester is represented by formula (7) or (8):

$$R^1O(R^2O)BOMe \quad (7)$$

$$R^3OB(OMe)_2 \quad (8)$$

wherein $R^1$, $R^2$, $R^3$ and Me have the same meanings as defined above.

Specific examples include dioctyl borate metal salts and oleyl borate metal salts.

The aforementioned component (C) preferably has an acid/alkali ratio by mole of 1:0.5 to 1.1.

Component (C) may be used singly or in combination of two or more species. Component (C) is used in an amount of 1 to 50 mass % on the basis of the total amount of the lubricant, preferably 2 to 20 mass %, more preferably 5 to 10 mass %. When the component (C) content is less than 1 mass %, working properties is poor, whereas when the content is in excess of 50 mass %, the effect commensurate with addition cannot be attained, which is economically disadvantageous.

The nonionic surfactant, serving as component (D) of the water-soluble metal working lubricant of the present invention, is preferably a glycol derivative, a glycerin derivative, or a polyhydric alcohol derivative. Examples of preferred nonionic surfactants include 2-ethylhexyl diethylenen glycol, dipropylene glycol, glycerin, diethylene glycol hexyl ether, and ethylene oxide-propylene oxide copolymers (e.g., Unilube 75DE2620, 75DE25, and 50MB2, products of Nippon Oil & Fats Co., Ltd.). Component (D) preferably has a molecular weight of 15,000 or less, more preferably 50 to 13,000. Component (D) may be used singly or in combination of two or more species. Component (D) is used in an amount of 10 to 80 mass % on the basis of the total amount of the lubricant, preferably 20 to 60 mass %. When the amount is less than 10 mass %, effect of dispersing other additives cannot be fully attained, whereas when the amount is in excess of 80 mass %, the effect commensurate with addition cannot be attained, which is economically disadvantageous.

The aforementioned component (E) used in the water-soluble metal working lubricant of the present invention is a biodegradation inhibitor and/or a metal deactivator.

No particular limitation is imposed on the type of the biodegradation inhibitor, and example include 2,4-dihydroxybenzanilides; mercaptoamidocarboxylic acids or salts thereof; thiazolidines such as dimethylthiazolidine, methylthiazolidine, and thiazolidine; polyethyleneimine; 2-phosphonobutane-1,2,4-tricarboxylic acid or a salt thereof; 1-hydroxyethylidene-1,1-diphosphonic acid or a salt thereof; tri-n-butyl-n-hexadecylphosphonium, tri-n-butyl-n-dodecylphosphonium, tetrakis-hydroxymethylphosphonium, and salts thereof; and hydroxyethylpiperazine. These species may be used singly or in combination of two or more species.

No particular limitation is imposed on the type of the metal deactivator, and example include benzotriazole; carboxybenzotriazole; thiazoles such as 2-mercaptothiazole and 2-aminothiazole; triazoles such as 3-aminotriazole, 4-aminotriazole, 2,5-diaminotriazole, 3-mercaptotriazole, and 3-amino-5-triazole; and imidazoles such as 2-mercaptoimidazole and 2-mercapto-1-methylimidazole. These species may be used singly or in combination of two or more species.

The aforementioned component (E) is preferably used in an amount of 0.01 to 10 mass % on the basis of the total amount of the lubricant. When the amount is less than 0.01 mass %, working properties may be poor, whereas when the amount is in excess of 10 mass %, the effect commensurate with addition cannot be attained in some cases, which is economically disadvantageous.

The water-soluble metal working lubricant of the present invention preferably has a pH of 7 to 12 from the viewpoint of working properties and preferably has a kinematic viscosity of 5 to 10,000 $mm^2/s$ at 40° C. When the kinematic viscosity is less than 5, working properties may be poor, whereas when the viscosity is in excess of 10,000, handling characteristics such as coatability may be impaired.

Into the water-soluble metal working lubricant of the present invention, other additives such as an anti-oxidant and a defoaming agent may be appropriately incorporated in accordance with need, without deviating the scope of the present invention. These additives may be used singly or in combination of two or more species.

Examples of the anti-oxidant include amines such as alkylated diphenylamine, phenyl-α-naphthylamine, and alkylated α-naphthylamine; phenols such as 2,6-di-t-butyl-p-creasol; and sulfur-containing species, and examples of the defoaming agent include dimethylpolysiloxane and fluoroethers.

The total amount of the aforementioned additives used in accordance with need is preferably 10 mass % or less on the basis of the total amount of the lubricant, more preferably 5 mass % or less.

EXAMPLES

The present invention will next be described in more detail by way of Examples, which should not be construed as limiting the invention thereto.

Examples 1 to 24 and Comparative Examples 1 to 7

(1) Preparation of Water-Soluble Metal Working Lubricants

In each case, components listed in Table 1 were added to water in amounts (based in the total amount of each lubricant) specified in Table 1, to thereby prepare each water-soluble metal working lubricant. In Table 1, lubricants having a water content of 0 were prepared by mixing components with water, followed by removing water.

(2) Properties Evaluation

Properties of each lubricant was evaluated through the following procedure. Results are shown in Table 1.

1. Lubricity test
   Coefficient of friction was determined through the Bauden test.
   Plate sample: A5182, Steel ball: SUJ2 (3/16 inch), Load: 5 kg, Speed: 20 mm/s, Sliding length: 50 mm, Test temperature: room temperature (25° C.)

2. Degreasing test
   Each lubricant sample was applied to a plate sample (A5182, 80×60), the plate sample was left to stand for 24 hours. After washing, percent area (%) of the decreased portion was determined.

3. Biodegradation test
   Performed in accordance with a test procedure employing Easicult M.

4. Anti-corrosion test
   A plate sample (A5182) was immersed in each lubricant (30 cc) at 60° C., and the appearance of the plate sample was observed after 3 days immersion.

5. Kinematic viscosity determination
   Determined in accordance with JIS K 2283.

6. Cylinder drawability test
   Punch A: Cr-plated, Punch B: Cr-non-plated, Plate sample: aluminum A6022, Punch diameter: ϕ40, Forming speed: 200 mm/s
   Evaluation: by forming height (mm)

7. Plate sliding test
   Mold A: Cr-plated, Mold B: Cr-non-plated, Plate sample: aluminum A6022, Sliding speed: 200 mm/s
   Evaluation: by coefficient of friction 8. Bulging test
   Plate sample: aluminum, Punch spherical head diameter: ϕ100, Cr-plated steel, Forming speed: 200 mm/s
   Evaluation: by bulging height (mm)

9. Weldability test
   A plate sample was arc-welded while a lubricant remained on the sample. The appearance of the arc-welded portion of the sample was observed.

TABLE 1

| | | | Ex. 1 | Ex. 2 | Ex. 3 | Ex. 4 | Ex. 5 | Ex. 6 |
|---|---|---|---|---|---|---|---|---|
| Amounts (mass %) | | Water | 60 | 20 | 60 | 15 | 60 | 35 |
| | Organic carboxylic acid salts | A1 | 10 | 20 | | | | |
| | | A2 | | | 10 | 50 | | |
| | | A3 | | | | | 10 | 30 |
| | | A4 | | | | | | |
| | Organic phosphates | B1 | 5 | 10 | 5 | 10 | | |
| | | B2 | | | | | 5 | 10 |
| | | B3 | | | | | | |
| | Surfactant | C1 | 25 | 50 | 25 | 25 | | |
| | | C2 | | | | | 25 | 25 |
| Evaluation | Lubricity | Friction coeff. | 0.08 | 0.06 | 0.08 | 0.05 | 0.09 | 0.05 |
| | Degreasing properties | Percent degrease(%) | 100 | 100 | 100 | 100 | 100 | 100 |

TABLE 1-continued

| | | | | | | | | |
|---|---|---|---|---|---|---|---|---|
| | Kinematic viscosity (40° C.) | $mm^2/s$ | 10.7 | 43.6 | 12.1 | 53.6 | 13.8 | 37.4 |

| | | | Comp. Ex. 1 | Comp. Ex. 2 | Comp. Ex. 3 | Comp. Ex. 4 | Comp. Ex. 5 |
|---|---|---|---|---|---|---|---|
| Amounts (mass %) | Water | | 92 | 65 | 60 | | |
| | Organic carboxylic acid salts | A1 | 2.5 | 10 | | | |
| | | A2 | | | | | |
| | | A3 | | | | | |
| | | A4 | | | 10 | | |
| | Organic phosphates | B1 | 0.5 | | | | |
| | | B2 | | | | | |
| | | B3 | | | 5 | | |
| | Surfactant | C1 | 5 | 25 | | | |
| | | C2 | | | 25 | | |
| Evaluation | Lubricity | Friction coeff. | 0.35 | 0.17 | 0.28 | 0.26 | 0.11 |
| | Degreasing properties | Percent degrease(%) | — | — | — | 0 | 0 |
| | Kinematic viscosity (40° C.) | $mm^2/s$ | 1.76 | 9.83 | 11.4 | 36.8 | — |

| | | | Ex. 1 | Ex. 7 | Ex. 8 | Comp. Ex. 6 | Comp. Ex. 7 |
|---|---|---|---|---|---|---|---|
| Amounts (mass %) | Water | | 60 | 60 | 60 | 60 | 60 |
| | Organic carboxylic acid salts | A1 | 10 | | | | |
| | | A5 | | 10 | | | |
| | | A6 | | | 10 | | |
| | | A7 | | | | 10 | |
| | | A8 | | | | | 10 |
| | Organic phosphates | B1 | 5 | 5 | 5 | 5 | 5 |
| | Surfactant | C1 | 25 | 25 | 25 | 25 | 25 |
| Evaluation | Lubricity | Friction coeff. | 0.08 | 0.08 | 0.09 | 0.23 | 0.36 |
| | Degreasing properties | Percent degrease(%) | 100 | 100 | 100 | 100 | 100 |
| | pH, 10% aq. solution | | 8.3 | 11 | 7.4 | 6.5 | 13.6 |
| | Kinematic viscosity (40° C.) | $mm^2/s$ | 10.7 | 10.1 | 12.8 | 23.6 | 9.4 |

| | | | Ex. 1 | Ex. 9 | Ex. 10 | Ex. 11 | Ex. 12 | Ex. 13 |
|---|---|---|---|---|---|---|---|---|
| Amounts (mass %) | Water | | 60 | | | 5 | | |
| | Organic carboxylic acid salts | A1 | 10 | 25 | | | | |
| | | A2 | | | 20 | | | |
| | | A9 | | | | 25 | | |
| | | A10 | | | | | 25 | |
| | | A11 | | | | | | 25 |
| | Organic phosphates | B1 | 5 | 15 | 10 | 10 | 15 | 40 |
| | Surfactant | C1 | 25 | 60 | 70 | 60 | | |
| | | C2 | | | | | 60 | 35 |
| Evaluation | Lubricity | Friction coeff. | 0.08 | 0.05 | 0.06 | 0.05 | 0.05 | 0.04 |
| | Degreasing properties | Percent degrease(%) | 100 | 100 | 100 | 100 | 100 | 100 |
| | Kinematic viscosity (40° C.) | $mm^2/s$ | 10.7 | 4360 | 2370 | 958 | 7340 | 3690 |

| | | | Ex. 14 | Ex. 15 | Ex. 16 | Ex. 17 | Ex. 18 | Ex. 19 | Ex. 20 |
|---|---|---|---|---|---|---|---|---|---|
| Amounts (mass %) | Water | | 40 | 49 | 48 | 35 | 35 | 30 | 40 |
| | Organic carboxylic acid salts | A1 | 20 | 20 | 20 | | | | 20 |
| | | A9 | | | | 25 | | | |
| | | A10 | | | | | 25 | | |
| | | A11 | | | | | | 30 | |
| | Organic phosphates | B1 | 5 | | 5 | 5 | 5 | | 5 |
| | | B2 | | 5 | | | | 5 | |
| | Surfactant | C1 | | 25 | 25 | | | | |
| | | C2 | 25 | | | 25 | 25 | 25 | 15 |
| | | C3 | | | | | | | 10 |

TABLE 1-continued

| | | | | | | | | | |
|---|---|---|---|---|---|---|---|---|---|
| | Biodegradation inhibitor | D1 | 5 | 0.5 | 1 | 8 | 6 | 2 | 5 |
| | Metal deactivator | E1 | 5 | 0.5 | 1 | 2 | 4 | 8 | 5 |
| Evaluation | Lubricity | Friction coeff. | 0.03 | 0.06 | 0.05 | 0.03 | 0.03 | 0.03 | 0.03 |
| | Degradation resistance | | good | good | good | good | good | good | good |
| | Corrosion resistance | | good | good | good | good | good | good | good |
| | Kinematic viscosity (40° C.) | $mm^2/s$ | 33.5 | 26.3 | 22.1 | 74.2 | 53.9 | 138 | 3520 |

| | | | Ex. 4 | Ex. 14 | Ex. 17 | Ex. 18 | Ex. 19 | Ex. 21 |
|---|---|---|---|---|---|---|---|---|
| Amounts (mass %) | Water | | 15 | 40 | 35 | 35 | 30 | 20 |
| | Organic carboxylic acid salts | A1 | | 20 | | | | |
| | | A2 | 50 | | | | | |
| | | A9 | | | 25 | | | |
| | | A10 | | | | 25 | | |
| | | A11 | | | | | 30 | |
| | | A12 | | | | | | 35 |
| | | A4 | | | | | | |
| | Organic phosphates | B1 | 10 | 5 | 5 | 5 | | 5 |
| | | B2 | | | | | 5 | |
| | | B3 | | | | | | |
| | Surfactant | C1 | 25 | | | | | 25 |
| | | C2 | | 25 | 25 | 25 | 25 | |
| | Biodegradation inhibitor | D1 | | 5 | 8 | 6 | 2 | 5 |
| | Metal deactivator | E1 | | 5 | 2 | 4 | 8 | 5 |
| Evaluation | Cylinder drawability forming height (mm) | Punch A | 13 | 14.5 | 13.7 | 13.9 | 13.7 | 14.7 |
| | | Punch B | 10.4 | 11.5 | 12.1 | 11.6 | 12.6 | 11.5 |
| | Coefficient of friction | Mold A | — | 0.004 | — | — | — | 0.006 |
| | | Mold B | — | 0.041 | — | — | 0.06 | 0.027 |

| | | | Comp. Ex. 1 | Comp. Ex. 2 | Comp. Ex. 3 | Comp. Ex. 4 |
|---|---|---|---|---|---|---|
| Amounts (mass %) | Water | | 92 | 65 | 60 | |
| | Organic carboxylic acid salts | A1 | 2.5 | 10 | | |
| | | A2 | | | | |
| | | A9 | | | | |
| | | A10 | | | | |
| | | A11 | | | | |
| | | A12 | | | | |
| | | A4 | | | 10 | |
| | Organic phosphates | B1 | 0.5 | | | |
| | | B2 | | | | |
| | | B3 | | | 5 | |
| | Surfactant | C1 | 5 | 25 | | |
| | | C2 | | | 25 | |
| | Biodegradation inhibitor | D1 | | | | |
| | Metal deactivator | E1 | | | | |
| Evaluation | Cylinder drawability forming height (mm) | Punch A | 7.2 | 10.3 | 9.1 | 10 |
| | | Punch B | 6.3 | 8.2 | 7.6 | 7.8 |
| | Coefficient of friction | Mold A | 0.108 | 0.091 | 0.097 | 0.101 |
| | | Mold B | 0.135 | 0.104 | 0.121 | 0.118 |

| | | | Ex. 14 | Ex. 22 | Ex. 23 | Ex. 24 | Comp. Ex. 1 | Comp. Ex. 2 | Comp. Ex. 3 | Comp. Ex. 4 |
|---|---|---|---|---|---|---|---|---|---|---|
| Amounts (mass %) | Water | | 40 | 8 | 25 | 60 | 92 | 65 | 60 | |
| | Organic carboxylic acid salts | A1 | 20 | 30 | 25 | 17 | 2.5 | 10 | | |
| | | A4 | | | | | | | 10 | |
| | Organic phosphates | B1 | 5 | 8 | 6 | 4 | 0.5 | | | |
| | | B3 | | | | | | | 5 | |
| | Surfactant | C1 | | | | | 5 | 25 | | |
| | | C2 | 25 | 38 | 32 | 15 | | | 25 | |

TABLE 1-continued

| | | | | | | | | | | |
|---|---|---|---|---|---|---|---|---|---|---|
| | Bio-degradation inhibitor | D1 | 5 | 8 | 6 | 2 | | | | |
| | Metal deactivator | E1 | 5 | 8 | 6 | 2 | | | | |
| Evaluation | Bulging height (mm) | | 34 | 35 | 35 | 32 | 21 | 27 | 24 | 25 |

| | | | Ex. 4 | Ex. 14 | Ex. 17 | Ex. 18 | Ex. 19 | Ex. 21 | Comp. Ex. 5 |
|---|---|---|---|---|---|---|---|---|---|
| Amounts (mass %) | Water | | 15 | 40 | 35 | 35 | 30 | 20 | |
| | Organic carboxylic acid salts | A1 | | 20 | | | | | |
| | | A2 | 50 | | | | | | |
| | | A9 | | | 25 | | | | |
| | | A10 | | | | 25 | | | |
| | | A11 | | | | | 30 | | |
| | | A12 | | | | | | 35 | |
| | Organic phosphates | B1 | 10 | 5 | 5 | 5 | | 5 | |
| | | B2 | | | | | 5 | | |
| | Surfactant | C1 | 25 | | | | | 25 | |
| | | C2 | | 25 | 25 | 25 | 25 | | |
| | Biodegradation inhibitor | D1 | | 5 | 8 | 6 | 2 | 5 | |
| | Metal deactivator | E1 | | 5 | 2 | 4 | 8 | 5 | |
| Evaluation | Weldability | | good | good | good | good | good | good | bad |

Components

A1 Potassium 7-ethylhexadecanedicarboxylate (acid/alkali mole ratio 1:0.9)

A2 Potassium oleate (acid/alkali mole ratio 1:0.9)

A3 Sodium palmitate (acid/alkali mole ratio 1:0.9)

A4 Sodium acetate (acid/alkali mole ratio 1:0.9)

A5 Potassium 7-ethylhexadecanedicarboxylate (acid/alkali mole ratio 1:1)

A6 Potassium 7-ethylhexadecanedicarboxylate (acid/alkali mole ratio 1:0.6)

A7 Potassium 7-ethylhexadecanedicarboxylate (acid/alkali mole ratio 1:0.3)

A8 Potassium 7-ethylhexadecanedicarboxylate (acid/alkali mole ratio 1:1.2)

A9 Potassium 8,13-dimethyleicosanedioate (acid/alkali mole ratio 1:0.9)

A10 Potassium 9,12-dimethyl-8,12-eicosadienedioate (acid/alkali mole ratio 1:0.9)

A11 Potassium 8,9-diphenylhexadecanedioate (acid/alkali mole ratio 1:0.9)

A12 Erucic acid (acid/alkali mole ratio 1:0.9)

B1 Mono-, dioctyl acid phosphate (acid/alkali mole ratio 1:0.9)

B2 Potassium monolauryl phosphate (acid/alkali mole ratio 1:0.9)

B3 Potassium monobutyl phosphate (acid/alkali mole ratio 1:0.9)

C1 Dipropylene glycol

C2 Glycerin

C3 Ethylene oxide-propylene oxide copolymers (75DE2620, product of NOF Corporation D1 Hydroxyethylpiperazine E1 Benzotriazole Comparative Example 4: Mineral oil (kinematic viscosity (40° C.); 30 $m^2/s$)+sulfurized oil (10 mass %)

Comparative Example 5: Paraffin wax+tricresyl phosphate (10 mass %)

INDUSTRIAL APPLICABILITY

According to the present invention, there can be provided a water-soluble metal working lubricant which is suitably employed particularly in press-working of aluminum material and which is excellent in both working properties (e.g., lubricity, cylinder drawability, plate slidability, bulging formability, and weldability) and degreasing properties.

The invention claimed is:

1. A water-soluble metal working lubricant comprising 60 mass % or less of water (A):

10 to 50 mass % of a metal salt of an organic carboxylic acid (B) wherein the carboxylic acid residue has 8 or more carbon atoms in total and the acid/alkali ratio by mole is 10.6 to 1.0;

4 to 40 mass % of at least one metal salt (C) selected from among an organic phosphate ester metal salt having an alkyl group having 8 or more carbon atoms in total, wherein the organic phosphate ester metal salt is represented by formula (1) or (2)

$$R^1O(R^2O)P(=O)OMe \quad (1)$$

$$R^3OP(=O)(OMe)_2 \quad (2)$$

wherein each of $R^1$ and $R_2$ represents an alkyl group having 8 or more carbon atoms in total; $R^3$ represents an alkyl group having 8 or more carbon atoms; and Me represents a metal element, 15 to 70 mass % of an non-ionic surfactant (D).

2. A water-soluble metal working lubricant as described in claim 1, which further comprises 0.01 to 10 mass % of a biodegradation inhibitor and/or a metal deactivator (E).

3. A water-soluble metal working lubricant as described in claim 1, wherein water serving as component (A) is contained in an amount of 50 mass % or less.

4. A water-soluble metal working lubricant as described in claim 1, wherein the metal salt serving as component (B) or (C) is an alkali metal, a divalent metal, or a trivalent metal salt.

5. A water-soluble metal working lubricant as described in claim 1, which has a kinematic viscosity of 5 to 10,000 $mm^2/s$ at 40° C.

6. A water-soluble metal working lubricant as described in claim 1, wherein the metal subjected to working is aluminum.

7. A water-soluble metal working lubricant as described in claim 1, wherein the metal salt (C) is an organic phosphate ester metal salt and is represented by formula (1) or (2):

$$R^1O(R^2O)P(=O)OMe \quad (1)$$

$$R^3OP(=O)(OMe)_2 \quad (2)$$

wherein each of $R^1$ and $R^2$ represents an alkyl group having 8 or more carbon atoms in total; $R^3$ represents an alkyl group having 8 or more carbon atoms; and Me represents a metal element.

8. A water-soluble metal working lubricant as described in claim 7, wherein the organic phosphate ester metal salt is selected from the group consisting of an octyl acid phosphate metal salt, an indecyl acid phosphate metal salt, a tridecyl acid phosphate metal salt, an oleyl acid phosphate metal salt, and a metal lauryl phosphate salt.

9. A water-soluble metal working lubricant as described in claim 1, wherein the metal salt (C) has an acid/alkali ratio by mole of 1:0.5 to 1.1.

10. A water-soluble metal working lubricant as described in claim 1, wherein the metal salt (C) is in an amount of 2 to 20 mass % on the basis of the total amount of the lubricant.

11. A water-soluble metal working lubricant as described in claim 1, wherein the metal salt (C) is in an amount of 5 to 10 mass % on the basis of the total amount of the lubricant.

12. A water-soluble metal working lubricant as described in claim 1, wherein the metal salt (C) is an alkali metal salt.

* * * * *